US010265733B2

(12) United States Patent
Kincaid et al.

(10) Patent No.: US 10,265,733 B2
(45) Date of Patent: Apr. 23, 2019

(54) SYSTEM AND METHOD FOR FACILITATING MANUAL SORTING OF OBJECTS

(71) Applicant: Agilent Technologies, Inc., Santa Clara, CA (US)

(72) Inventors: Robert Kincaid, Half Moon Bay, CA (US); Melanie Tory, Sunnyvale, CA (US); Joachim Schmid, Carpinteria, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 15/800,995

(22) Filed: Nov. 1, 2017

(65) Prior Publication Data

US 2018/0050370 A1 Feb. 22, 2018

Related U.S. Application Data

(63) Continuation of application No. 14/968,605, filed on Dec. 14, 2015, now Pat. No. 9,839,941, which is a (Continued)

(51) Int. Cl.
*B07C 7/00* (2006.01)
*B07C 5/342* (2006.01)

(52) U.S. Cl.
CPC ..... *B07C 5/3422* (2013.01); *B07C 7/005* (2013.01)

(58) Field of Classification Search
CPC ..... B07C 5/3412; B07C 5/3422; B07C 5/36; B07C 7/00; B07C 7/005; B07C 7/04; G06F 3/048
See application file for complete search history.

(56) References Cited

U.S. PATENT DOCUMENTS 5,794,789 A 8/1998 Payson
928,641 A 7/1999 Divine
(Continued)

FOREIGN PATENT DOCUMENTS

CN 1287913 C 12/2006
WO 2013/170204 A1 11/2013
WO WO 2014-200618 A1 12/2014

OTHER PUBLICATIONS

International Search Report dated Aug. 27, 2014 in PCT/US2014/034045.
(Continued)

*Primary Examiner* — Joseph C Rodriguez

(57) ABSTRACT

An apparatus that facilitates the manual sorting of objects is disclosed. The apparatus includes a display surface having a surface that can be selectively illuminated and that is adapted for receiving the objects. An identification reader reads identification information stored on the objects. A controller causes an area on the display surface corresponding to one of the objects to be illuminated based on the identification information and indicates a location to which the illuminated object is to be moved. In one aspect of the invention, the display surface includes an area adapted for positioning a receiver for the objects. The display surface provides an indication of a position in the receiver at which the one of the objects is to be placed.

14 Claims, 4 Drawing Sheets

Related U.S. Application Data continuation of application No. PCT/US2014/034045, filed on Apr. 14, 2014.

(60) Provisional application No. 61/835,386, filed on Jun. 14, 2013.

(56) References Cited

U.S. PATENT DOCUMENTS

| | | | | |
|---|---|---|---|---|
| 5,998,751 | A | 12/1999 | Brunelle | |
| 6,243,620 | B1 | 6/2001 | Robinson | |
| 6,298,275 | B1 * | 10/2001 | Herman, Jr. | B26D 5/00 382/111 |
| 6,370,446 | B1 | 4/2002 | Divine | |
| 6,580,962 | B2 | 6/2003 | Rapoza | |
| 6,685,031 | B2 | 2/2004 | Takizawa | |
| 6,786,404 | B1 | 9/2004 | Bonner | |
| 6,847,481 | B1 | 1/2005 | Ludi | |
| 6,878,896 | B2 | 4/2005 | Braginsky | |
| 7,090,134 | B2 * | 8/2006 | Ramsager | B07C 3/18 235/454 |
| 7,221,276 | B2 * | 5/2007 | Olsen, III | B07C 7/005 340/572.1 |
| 7,561,717 | B2 | 7/2009 | Anderson | |
| 7,863,889 | B1 | 1/2011 | Bamrungtham | |
| 8,260,455 | B2 * | 9/2012 | Redford | B07C 3/14 209/546 |
| 8,676,509 | B2 | 3/2014 | De La Torre-Bueno | |
| 8,712,118 | B2 | 4/2014 | De La Torre-Bueno | |
| 8,825,200 | B2 * | 9/2014 | Carpenter | B07C 7/005 700/223 |
| 8,863,961 | B2 | 10/2014 | Carpenter | |
| 8,947,456 | B2 * | 2/2015 | Chen | G09G 5/00 345/629 |
| 9,233,401 | B2 | 1/2016 | Miette | |
| 9,321,083 | B2 * | 4/2016 | Volta | B07C 7/005 |
| 9,646,369 | B2 * | 5/2017 | Salzman | G06T 7/0004 |
| 9,727,838 | B2 * | 8/2017 | Campbell | G06Q 10/087 |
| 9,839,941 | B2 * | 12/2017 | Kincaid | B07C 5/3422 |
| 10,088,655 | B2 * | 10/2018 | Virk | G02B 21/002 |
| 2003/0116481 | A1 | 6/2003 | Takizawa | |
| 2004/0016684 | A1 * | 1/2004 | Braginsky | B07C 7/005 209/702 |
| 2005/0149226 | A1 | 7/2005 | Stevens | |
| 2007/0073585 | A1 | 3/2007 | Apple | |
| 2008/0239478 | A1 | 10/2008 | Tafas | |
| 2010/0318215 | A1 | 12/2010 | Bentele | |
| 2012/0056717 | A1 | 3/2012 | Maharbiz | |
| 2016/0139387 | A1 | 5/2016 | Birk | |
| 2017/0038912 | A1 | 2/2017 | Nishida | |

OTHER PUBLICATIONS

Extended European Search Report dated Jan. 5, 2017, EP Application No. 14811005.

Office Action dated Dec. 7, 2017, China Application No. 201480033762.X.

Office Action dated Dec. 4, 2017, EP Application No. 14811005.9.

Nonfinal Office Action dated Jun. 4, 2018, U.S. Appl. No. 15/424,700.

Notice of Allowance dated Oct. 5, 2018, U.S. Appl. No. 15/424,700.

Office Action dated Jul. 9, 2018, China Application No. 201480033762.X.

* cited by examiner

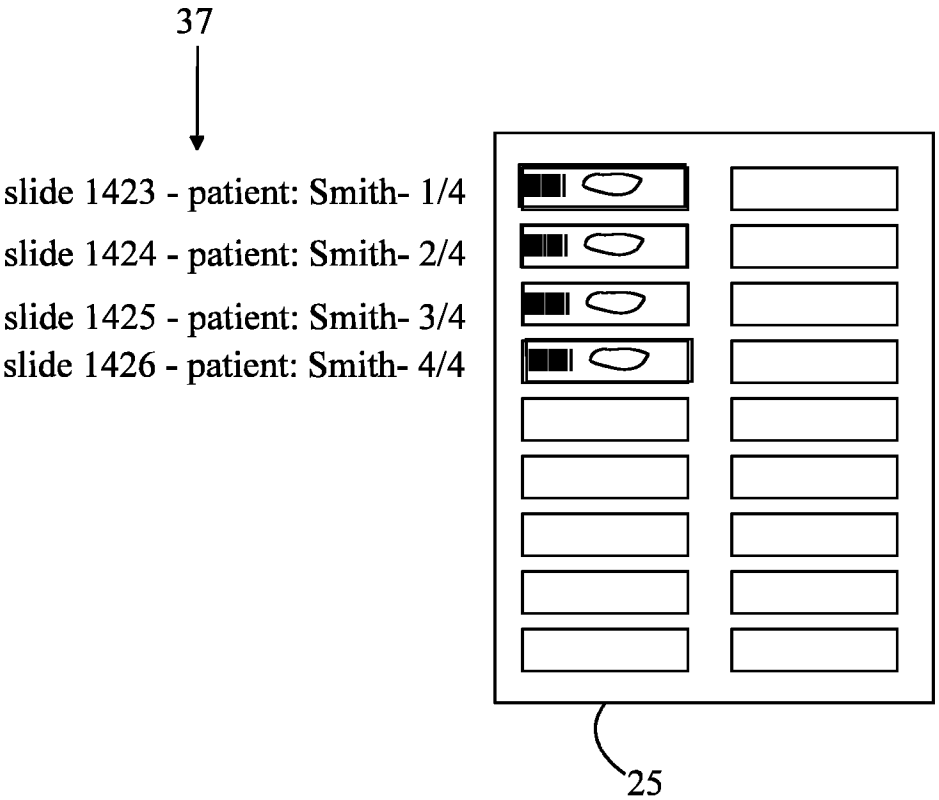
FIG. 2
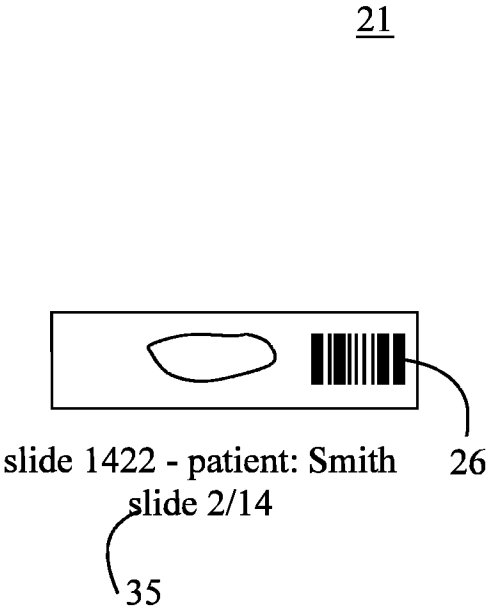

SYSTEM AND METHOD FOR FACILITATING MANUAL SORTING OF OBJECTS

CROSS-REFERENCE TO RELATED PATENT APPLICATIONS

This application is a continuation of co-pending U.S. patent application Ser. No. 14/968,605 filed on Dec. 14, 2015 which is a continuation under 35 U.S.C. § 111 of PCT/US14/34045 filed on Apr. 14, 2014, said PCT application claiming priority from U.S. Provisional Patent Application 61/835,386 filed on Jun. 14, 2013, said patent applications being incorporated by reference herein.

BACKGROUND OF THE INVENTION

A number of tasks can be characterized as sorting problems in which a collection of objects having similar sizes and shapes are to be sorted manually into groups based on a label or other indicator on each object. For example, in histopathology laboratories, specimens that have been prepared from patient tests and mounted on microscope slides must be sorted into trays for viewing by various pathologists who work in the laboratory. A tray typically includes the slides for a particular patient in an order that depends on the particular pathologist who is assigned to view the slides and on the type of samples on the slides. Slide sorting is one of the time consuming and manual tasks in histopathology laboratories, and is not easily automated. In addition to manually organizing slides into folders or trays, descriptive reports must also be included prior to distribution to pathologists for diagnosis. Slide sorting is a major bottleneck in histopathology laboratory workflows.

Fully automated slide sorting systems in which robots sort the slides and place them in the trays present challenges because of the high cost of replacing a slide that is damaged in the automated handling. In many cases, replacing a slide is impossible, since the original patient sample is depleted and obtaining another sample requires surgery or other invasive procedures on the patient. Hence, a fully automated sorting system has not found widespread acceptance.

In other sorting problems, robotic solutions present problems because the shape of the samples being sorted does not lend itself to automated handling. For example, if the samples differ markedly in shape providing a robotic device for picking up the objects and placing them in the final container presents challenges. Similarly, if a number of different sample types are to be sorted at different times, the setup time for changing the manipulator on the robot can make such systems impractical. Similarly, fragile samples can present handling problems for robotic systems.

SUMMARY OF THE INVENTION

The present invention includes an apparatus and method that facilitates the manual sorting of objects. The apparatus includes a display surface having a surface that can be selectively illuminated and that is adapted for receiving the objects. An identification reader reads identification information stored on the objects. A controller causes an area on the display surface corresponding to one of the objects to be illuminated based on the identification information and indicates a location to which the illuminated object is to be moved. In one aspect of the invention, the display surface includes an area adapted for positioning a receiver for the objects. The display surface provides an indication of a position in the receiver at which one of the objects is to be placed.

In one aspect of the invention, the identification reader includes a camera that provides images of labels on the objects.

In another aspect of the invention, the controller causes information about one of the objects to be displayed in an area corresponding to that one of the objects.

In yet another aspect of the invention, the identification reader determines a location and orientation for each of the objects located on the display surface.

In a still further aspect of the invention, the display surface includes a projector that projects an image onto a surface on which the objects are placed.

In yet another aspect of the invention, the display surface includes a touch enabled display.

In another aspect of the invention, the display surface includes a plurality of detents adapted for receiving the objects and a receiver at predetermined positions and orientations. The display surface can include a light source adjacent to each of the detents, the light source is selectively illuminated to indicate an object in the detent as the one of the objects.

BRIEF DESCRIPTION OF THE DRAWINGS

FIG. 2 illustrates a slide format that can be utilized with the present invention and a portion of the display surface around the slide.

DETAILED DESCRIPTION OF THE PREFERRED EMBODIMENTS OF THE INVENTION

Figure 1A:
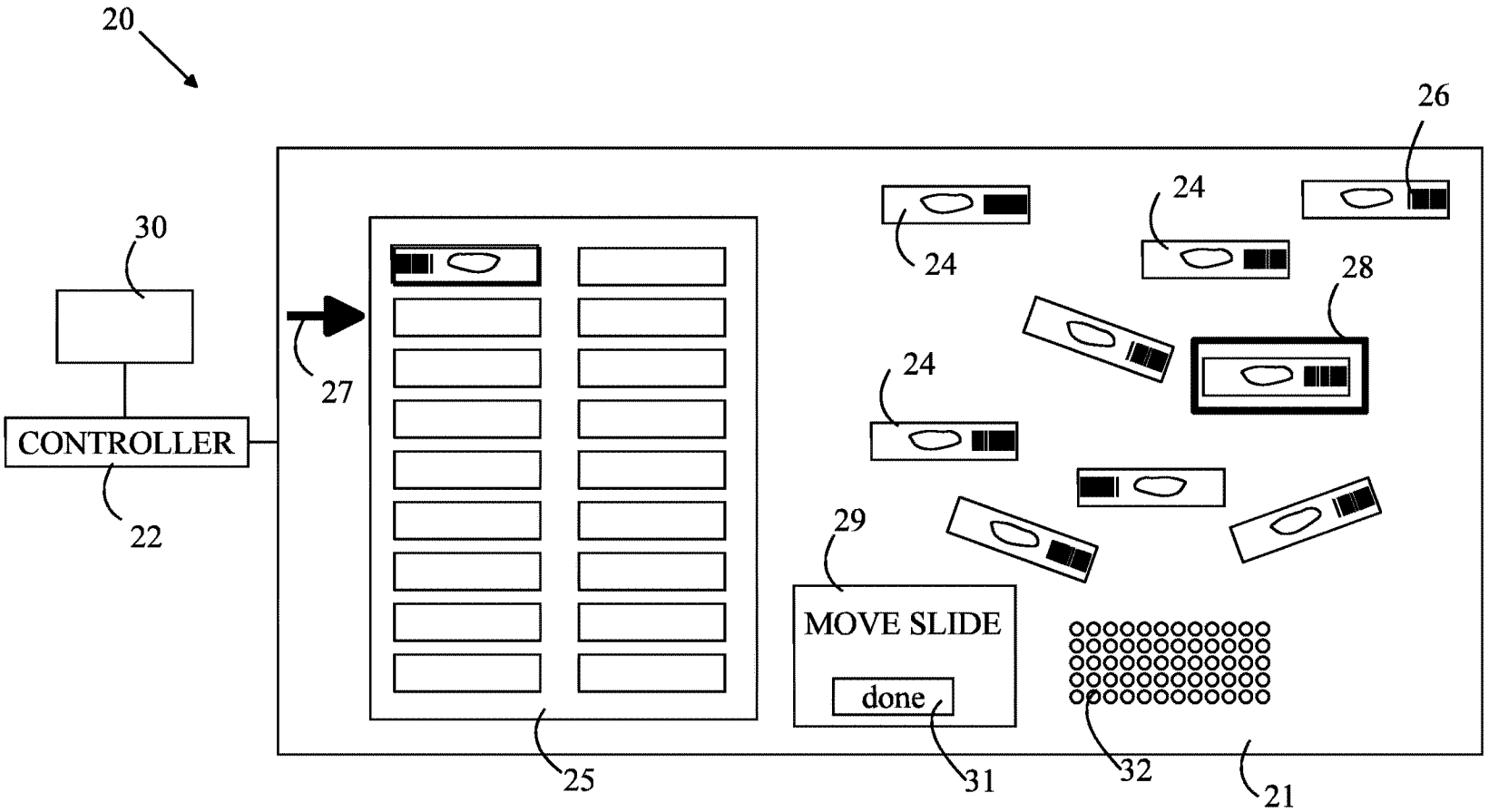
FIGS. 1A and 1B illustrate a slide sorting workbench according to one embodiment of the present invention.
Figure 1B:
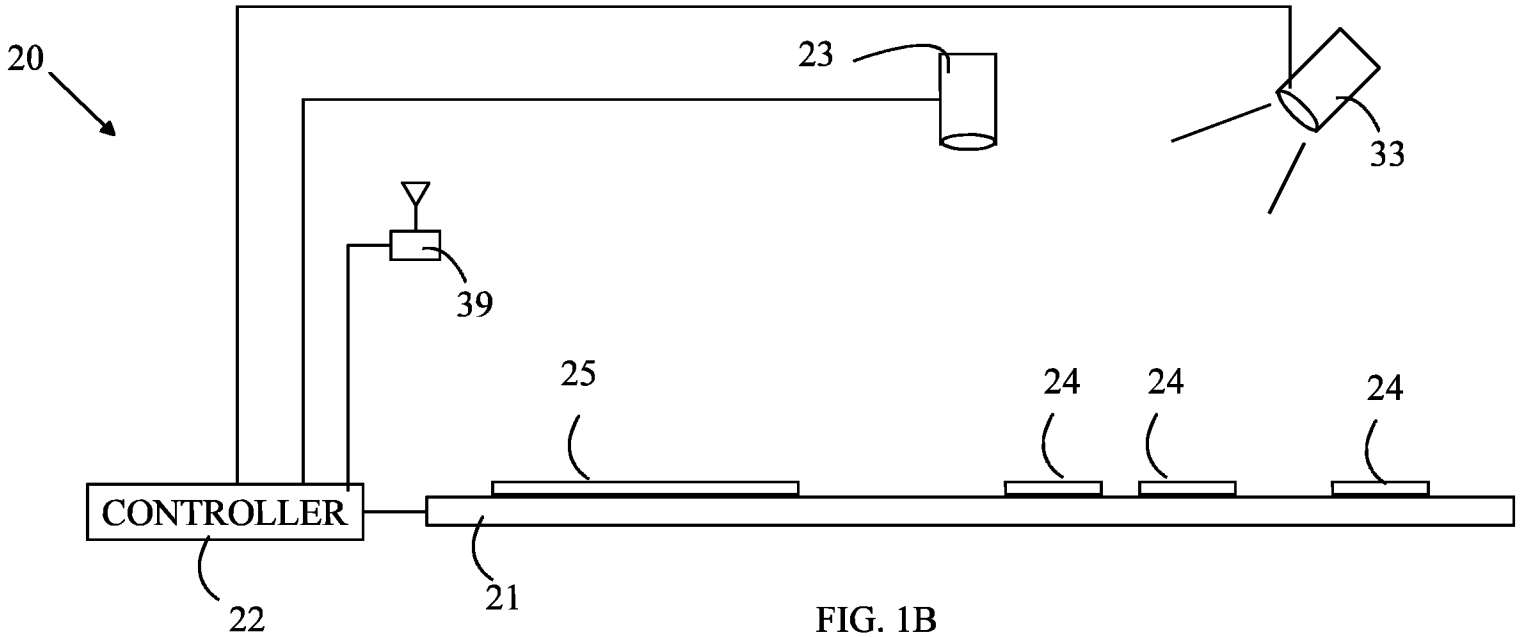

The manner in which the present invention provides its advantages can be more easily understood with reference to the problem of sorting microscope slide mounted samples in a pathology laboratory. Refer now to FIGS. 1A and 1B, which illustrate a slide sorting workbench according to one embodiment of the present invention. FIG. 1A is a top view of the workbench, and FIG. 1B is a side view of the workbench. Workbench 20 includes a horizontal display surface 21 that is connected to a controller 22 and performs the functions of a controller display screen on controller 22. Items placed on horizontal display surface 21 are viewed by a camera 23 that provides input to controller 22 which includes software that extracts relevant information from the images. Controller 22 controls the information displayed on horizontal display surface 21 and processes the information provided by camera 23. The slides to be sorted 24 and the tray 25 that is to receive the slides are placed on the display surface. Each slide includes a controller readable label 26 that is viewable by camera 23. A user of the system picks up a slide from horizontal display surface 21 and places that slide in tray 25 at the location indicated by marker 27. The slide to be moved is indicated by a visual indicator 28 on horizontal display surface 21 that is generated in the region of the slide that is to be moved. In the example shown in the figures, the region around the slide to be moved is illuminated.

Controller 22 continuously monitors the positions of the slides on horizontal display surface 21. When controller 22 detects that the indicated slide has been moved to the desired location, the controller updates marker 27 to point to the next location in tray 25 that is to be filled and illuminates the corresponding next slide to be moved on horizontal display surface 21. The process is completed when all of the slides that are destined for tray 25 have been sorted into the correct locations on tray 25 or until tray 25 is filled. If more slides remain to be sorted, the controller instructs the user to place a new tray at an indicated location on horizontal display surface 21. The process then continues as described above.

In one aspect of the invention, the controller verifies the placement of the slides in the tray to ensure that the slides are in their appropriate positions. If the controller detects that a slide is out of position or the wrong slide has been placed in the tray at the currently indicated position, the controller displays a warning message to the user. For example, if the slide is in the wrong position, the controller instructs the user to move the slide at the location marked by a first symbol to the location marked by a second symbol. If the wrong slide has been placed in the tray, the controller instructs the user to replace the slide at the indicated location with the slide that is currently illuminated on the display surface.

The communications between the user and the controller can utilize a free area 29 on horizontal display surface 21 or a separate graphical user interface 30. In one aspect of the present invention, horizontal display surface 21 is a touch enabled display. In such embodiments, the user can then respond to commands from the controller by touching an area 31 associated with the command on horizontal display surface 21. In addition, an area 32 of horizontal display surface 21 can be used to simulate a keyboard in such touch enabled display when the user needs to type information into the controller.

Horizontal display surface 21 can be implemented using a conventional touch enabled computer monitor screen or a combination of a projector 33 and camera 23. The projector can generate a scan pattern on the surface of horizontal display surface 21 or display an image.

As noted above, the order in which slides appear in the tray can depend on the specific pathologist who is assigned to view the slides. The order in which the slides appear in the tray is determined by a listing in the controller. In one aspect of the invention, different orders are provided for different pathologists. Typically, a group of slides related to a given patient constitute a "case". When slides are being tracked by a laboratory information system (LIS), the slides will have patient and/or case identification. Cases are typically assigned to a given pathologist manually and entered into the LIS prior to the sorting procedure. The receivers for the slides are typically folders that can be tagged with a machine readable identification tag and tracked so that one or more cases can be preassigned to that folder. When the folder is placed on the work surface, it is immediately recognized by a tag or barcode on the folder and the appropriate slides illuminated for transfer. If a generic folder that is not pre-assigned is presented, the controller presents a user dialogue so that the user can assign the folder to a particular pathologist.

Refer now to FIG. 2, which illustrates a slide format that can be utilized with the present invention and a portion of the display surface around the slide. The above-described embodiments depend on the ability of the controller to read the labels on each slide. The labels can include a bar code or similar indicia that identifies each slide and is assigned by the individual who prepared the slide. The label can also include a limited amount of human readable textual information that provides information about the slide. However, in many situations, the amount of textual information that can be provided in a readable form on the label is much less than the amount of information that is available on the specimen included on the slide. The additional information is typically stored in a database that is indexed by a serial number on the slide label that is encoded in the barcode. In one aspect of the present invention, the controller accesses the database and displays selected portions of the data next to the slide on horizontal display surface 21 as shown at 35. This feature of the display surface is also useful when the pathologist is viewing the slides assuming that the pathologist has a similar display surface at his work station. In this case, the pathologist places the tray or the individual slides on the work surface and the controller displays the additional data in an area adjacent to the slide as shown at 37.

In the above-described embodiments, the controller identifies the slides by utilizing a camera that views the items on horizontal display surface 21. However, other forms of identification reader could be utilized to detect and read the machine readable identification tags. For example, the labels could include an RFID tag that is powered by a light signal being received by the label. A light signal that illuminates a single slide can be provided by projector 33 shown in FIG. 1B. Upon being illuminated, the label derives sufficient power from the illumination signal to power an RF transmitter chip in the label which then transmits the serial number stored in the label to an RF receiver such as RF receiver 39 shown in FIG. 1B. The items on the surface of the display surface are then detected by scanning the surface with a light beam and detecting the RF transmissions associated with locations that are illuminated.

RF receiver 39 can also include an RF source such as an RF transmitter that activates the various RFID tags and reads the transmitted information. In such embodiments, the controller must determine the location of the RFID that is currently responding to the RF transmitter. In one aspect of the invention, the transmitter illuminates only one object at a time. The transmitter can be a beam forming transmitter that scans the display surface. In another embodiment, the RF transmitter and receiver are connected to a mechanism that scans the display surface mechanically such that only one RFID tag is scanned at a time and the location of that RFID tag is determined by the position of the scanning mechanism.

Figure 3:
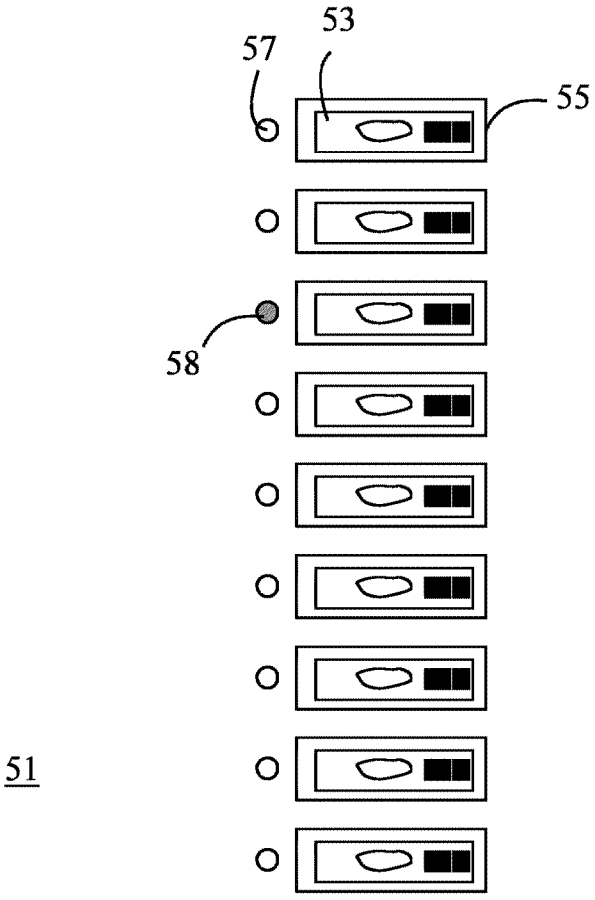
FIG. 3 illustrates a display surface in which a tray and a plurality of slides are located at fixed locations.
Figure 3:
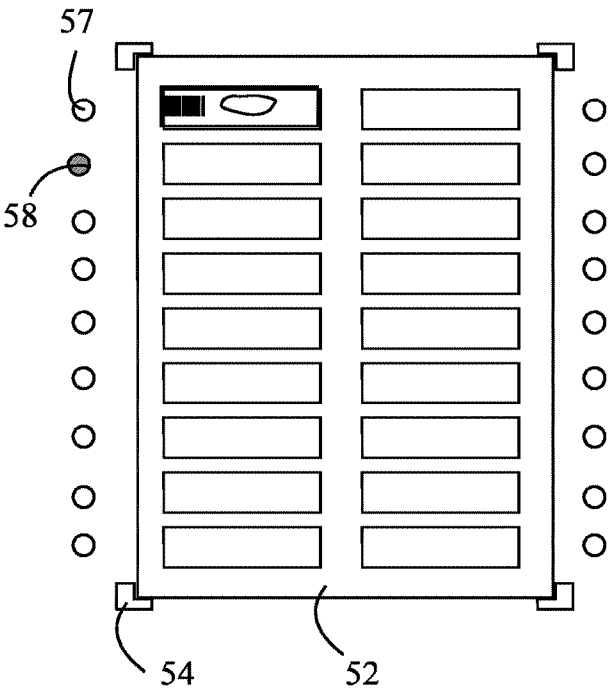

In the above-described examples, the tray and the slides are placed at random locations on the display surface, and the controller uses the camera to identify the objects and their locations on the display surface. However, embodiments in which the tray or slides are placed at predetermined locations on the display surface can also be constructed, which simplifies the process of locating the slides and the labels. Refer now to FIG. 3, which illustrates a display surface 51 in which a tray 52 and a plurality of slides such as slide 53 are located at fixed locations. The locations can be specified by detents 54 on the display surface that confine the objects to defined locations or by depressions 55 which provide a similar function. For the purposes of the present discussion the term "detent" will be used for any mechanism that confines an object to a specific orientation at a specific location. In such an arrangement, the display surface can be simplified to a surface with indicator lights 57 at each object location. The item to be moved is indicated by lighting the indicator light adjacent to the location having the item as shown at 58. Similarly, the destination location is indicated by the indicator light adjacent to the receiving slot in the tray as shown at 59. Placing the items in predetermined locations also simplifies the controller identification of the objects, since the controller can narrow the areas in the field of view that need to be searched to the predetermined locations. In addition, the controller does not need to account for the possibility that the items are placed on the display surface with arbitrary rotations.

While the above-described embodiments are adapted for sorting slides into trays, the present invention can be utilized to facilitate any manual sorting task in which objects that can be identified by the controller are to be sorted to locations in a receiver. The controller only needs to be able to read an ID tag on each object and access a list that indicates where in the receiver the object is to be placed. Since the object is being moved manually, the problems associated with automating the pickup and movement of objects with different shapes or fragilities are avoided.

The controller in the above-described embodiments can be implemented in a general purpose data processing system or computer in which the display surface is one of the displays on the data processing system. Such embodiments are preferred, since the controller can take advantage of information stored on a network in which the controller participates. This allows the controller to access identification information corresponding to any particular identification number read from an object on the display surface. Embodiments in which the controller is implemented as a special purpose processor can also be constructed.

The cameras in the above-described embodiments are positioned over the work surface. However, embodiments in which the cameras are under a transparent work surface can also be constructed. In addition, embodiments in which cameras are provided on both sides of the work surface can be constructed. Similarly, the projectors can be positioned under a transparent work surface.

The above-described embodiments of the present invention have been provided to illustrate various aspects of the invention. However, it is to be understood that different aspects of the present invention that are shown in different specific embodiments can be combined to provide other embodiments of the present invention. In addition, various modifications to the present invention will become apparent from the foregoing description and accompanying drawings. Accordingly, the present invention is to be limited solely by the scope of the following claims.

What is claimed is:

1. An apparatus for facilitating manual sorting of objects, said apparatus comprising:

an identification reader that reads identification information associated with each of said plurality of said objects while said objects are on a stationary surface that is adapted for receiving a plurality of objects that are to be sorted; and a controller that identifies one of said plurality of said objects by illuminating said one of said plurality of objects while said one of said plurality of objects is on said stationary surface, said identification being based on said identification information, and indicates a location to which said one of said plurality of objects is to be moved.

2. The apparatus of claim 1 wherein said stationary surface comprises an area adapted for positioning a receiver for one of said plurality of said objects, said controller providing an indication of a position in said receiver where said one of said objects is to be placed, said receiver having a plurality of locations adapted to receive said objects.

3. The apparatus of claim 1 wherein said identification reader comprises a camera that captures images of said identification information associated with said plurality of said objects.

4. The apparatus of claim 1 wherein said controller causes information about one of said plurality of said objects to be displayed in an area corresponding to that one of said plurality of said objects.

5. The apparatus of claim 1 wherein said identification reader determines a location and orientation for each of said objects that is located on said stationary surface.

6. The apparatus of claim 1 wherein said stationary surface comprises a controller display screen.

7. The apparatus of claim 1 wherein said apparatus comprises a projector that projects an image onto said stationary surface.

8. The apparatus of claim 1 wherein said stationary surface comprises a touch enabled display.

9. The apparatus of claim 1 wherein said stationary surface comprises a plurality of detents adapted for receiving said objects at predetermined positions and orientations.

10. The apparatus of claim 1 wherein said stationary surface comprises a detent for receiving a receiver that is adapted to receive one of said plurality of said objects.

11. The apparatus of claim 9 wherein said stationary surface comprises a light source adapted to selectively illuminate an area associated with each of said plurality of said detents.

12. The apparatus of claim 1 wherein said identification reader comprises an RF receiver that receives identification signals from one of said plurality of said objects identified by said controller.

13. The apparatus of claim 12 wherein said identification reader comprises an RF source that selectively illuminates said objects.

14. A method for sorting objects comprising placing said objects and one or more receivers for said objects on a stationary surface, each of said objects associated with a machine readable identification tag;

(a) causing a data processing system to identify an area on said stationary surface corresponding to one of said objects and an area on one of said receivers corresponding to a location in said receiver based on said machine readable identification tag associated with said one of said objects;

(b) determining that said one of said objects has been moved to said location;

repeating steps (a) and (b) until there is no object on said stationary surface that has an association with said one or more receivers.

* * * * *